US006722955B2

(12) United States Patent
Telischak et al.

(10) Patent No.: US 6,722,955 B2
(45) Date of Patent: Apr. 20, 2004

(54) BUCKUP PLATE ASSEMBLY FOR GRINDING SYSTEM

(75) Inventors: John Telischak, Apple Valley, MN (US); David C. Roeker, Hudson, WI (US); Joseph G. Pribyl, Eagan, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 202 days.

(21) Appl. No.: 09/757,954

(22) Filed: Jan. 10, 2001

(65) Prior Publication Data

US 2002/0090900 A1 Jul. 11, 2002

(51) Int. Cl.[7] ..... B24B 1/00

(52) U.S. Cl. ..... 451/54; 451/359; 451/353; 451/539

(58) Field of Search ..... 451/359, 353, 451/285, 287, 526, 529, 530, 539, 28, 54

(56) References Cited

U.S. PATENT DOCUMENTS

| | | | | |
|---|---|---|---|---|
| 4,439,953 | A | 4/1984 | Block et al. | |
| 4,683,684 | A | 8/1987 | Yie | |
| 4,932,163 | A | 6/1990 | Chilton et al. | |
| 5,545,082 | A | 8/1996 | Courson et al. | |
| 5,795,989 | A | 8/1998 | Simmons et al. | |
| 5,938,514 | A | 8/1999 | Amin et al. | |
| 5,947,805 | A | 9/1999 | Van Osenbruggen | |
| 5,962,120 | A | 10/1999 | Keipert | |
| 6,007,415 | A | 12/1999 | Van Osenbruggen | |
| 6,059,644 | A | 5/2000 | Manor et al. | |
| 6,062,965 | A | 5/2000 | Knowlton | |
| 6,077,156 | A | 6/2000 | Amin et al. | |
| 6,142,858 | A | 11/2000 | Luedeke | |
| 6,173,470 | B1 | 1/2001 | van Osenbruggen | |
| 6,454,630 | B1 * | 9/2002 | Tolles | 451/6 |
| 6,494,766 | B1 * | 12/2002 | Wiswesser et al. | 451/6 |

FOREIGN PATENT DOCUMENTS

| | | |
|---|---|---|
| CA | 1 172 854 | 8/1984 |
| WO | WO 97/14537 | 4/1997 |
| WO | WO 00/64634 | 11/2000 |

OTHER PUBLICATIONS

Carborundum Abrasive brochure entitled "E–ZView", May 1998, 4 pages.

MetalFab AVOS Product Catalog, pp. M30 and M31, publication date prior to filing date of instant application.

* cited by examiner

*Primary Examiner*—Eileen P. Morgan
(74) *Attorney, Agent, or Firm*—Gary L. Griswold; Rick L. Franzen

(57) ABSTRACT

An abrasive article backup plate assembly and grinder system having an abrasive article backup plate assembly is disclosed. The abrasive article backup plate assembly includes an abrasive article having an abrasive surface that includes a viewing window within the abrasive surface. A support member is provided including a first major surface which supports the abrasive article. At least a portion of the support member is made of materials sufficiently clear to collectively see through the support member and the viewing window. A method of abrading a surface using a grinder system including the abrasive article backup plate assembly is also disclosed.

41 Claims, 9 Drawing Sheets

BUCKUP PLATE ASSEMBLY FOR GRINDING SYSTEM

FIELD OF THE INVENTION

The present invention relates generally to a backup plate assembly for grinding systems, preferably a backup plate assembly for use in a grinding system which allows observation of a work surface during operation of the grinding system.

BACKGROUND OF THE INVENTION

High-speed grinders are used for many different applications for abrading a work surface. Typical rotary grinders include a rotatable shaft extending from the grinder. An abrasive disc attached to a backup plate is mounted on an end of the rotatable shaft. Typical grinding operations include positioning the grinding system at an angle relative to the work surface during operation of the grinding system. The grinder is held at an angle, such that the rotatable shaft is angled relative to a plane of the work surface. Typical grinding angles range from about 5° to 45°. An outer edge of the abrasive disc and backup plate assembly is pressed against the work surface while the grinder is operated. The result is an abrading of the work surface by the abrasive article.

During operation of the grinder system on a work surface it is desirable to view the abraded portion of the work surface. Typically, this is accomplished by abrading the work surface, moving the grinder system to view the abraded portion of the work surface, and repositioning the grinder system at the abraded portion of the work surface. This routine is repeated until grinding is complete.

Modifications have been made to the abrasive disc and backup plate assembly in order to view the abraded work surface during operation of the grinder system (see, for example, U.S. Pat. No. 6,007,415 (Van Osenbruggen)). Known abrasive disc and backup plate assembly designs include circular openings or apertures in a sanding disc and corresponding circular openings or apertures in the backup plate. When rotated at a high speed during operation of the grinder system, the abraded work surface is viewable through the apertures in the sanding disc and apertures in the backup plate. This type of sanding disc and backup plate assembly requires that the openings in the sanding disc be designed to match with the openings in the backup plate. The openings in the sanding disc must be registered and aligned with the openings in the backup plate, and such registration must be maintained while mounting the sanding disc and backup plate assembly on the grinder system rotatable shaft.

Other abrasive disc and backup pad assemblies include portions or regions removed from the outside perimeters of the abrasive disc and backup plate to enable viewing of an abraded work surface during operation of a grinder system (see, for example, U.S. Pat. No. 6,062,965 (Knowlton)). Again, the removed regions about the outer perimeters of the sanding disc must correspond to the removed regions about the outer perimeter of the backup plate. The sanding disc removed regions must be registered and aligned to the removed regions of the backup plate and secured to the rotatable shaft of the grinder system. Another known grinding disc is disclosed having both apertures extending through the disc surface and removed regions spaced about the outer circumference of the grinding disc (see, for example, U.S. Pat. No. 6,077,156 (Amin et al.)).

It is also known to provide openings or apertures in a grinder backup plate as part of a dust control system. The dust control system includes a shroud placed over the openings in the backup plate and is connected to a vacuum source. During operation of the grinder, dust, dirt, and abraded material (termed "swarf") is removed through the apertures and shroud via the vacuum system (see, for example, U.S. Pat. No. 4,932,163 (Chilton et al.)).

Other known systems have been designed to aid in cooling of the abrasive disc during grinder operation, thereby extending the useful life of the abrasive disc. For example, one known design includes, a plurality of ribs extending from a surface of the backup plate. The ribs extending from a surface of the backup plate provide both channels for removal of "swarf" or other undesirable materials during operation of the grinder system while providing a cooling effect to the grinding disc.

SUMMARY OF THE INVENTION

The present invention relates generally to an abrasive article backup plate assembly for grinding systems, preferably an abrasive article backup plate assembly for use in a grinding system which allows observation of an abraded surface during operation of the grinding system and grinding systems employing such assemblies.

In one embodiment, the present invention provides an abrasive article backup plate assembly. The abrasive article backup plate assembly includes an abrasive article having an abrasive surface that includes a viewing window (preferably, two or more viewing windows) within the abrasive surface. A support member is provided which includes a first major surface which supports the abrasive article. At least a portion of the support member is made of material sufficiently clear to collectively see through the support member and the viewing window. For embodiments in which the assembly rotates during use, preferably at least a portion of the support member is made of material sufficiently clear to allow observation of a work surface collectively through the support member and the viewing window during rotation of the assembly about an axis substantially perpendicular to the first major surface.

In another embodiment, the present invention provides an abrasive article backup plate assembly. The abrasive article backup plate assembly includes an abrasive article having an abrasive surface having an average diameter. A portion of the abrasive surface projects beyond the average diameter such that there is a first viewing area between a first two adjacent portions of the abrasive surface that project beyond the average diameter of the abrasive surface. A support member is provided including a first major surface which supports the abrasive article. A portion of the support member is made of material sufficiently clear to collectively see through the support member and the abrasive article viewing area. For embodiments in which the assembly rotates during use, preferably at least a portion of the support member is made of material sufficiently clear to allow observation of a work surface collectively through the support member and the viewing window during rotation of the assembly about an axis substantially perpendicular to the first major surface. Optionally, the abrasive article includes two or more viewing areas. Optionally, the viewing area(s) is a viewing window(s). In another aspect, the abrasive article includes a viewing window(s) in addition to the viewing area(s).

In another embodiment, the present invention provides a grinder system. The grinder system includes a grinder having a shaft (typically, longitudinally extending shaft) and an abrasive article backup plate assembly according to the present invention attached thereto. Typically, a hub system is attached to the support member, wherein the hub system is connectable to the longitudinally extending shaft.

The present invention also provides a method of abrading a surface utilizing an abrasive article backup plate assembly according to the present invention. At least a portion of the abrasive of the abrasive article backup plate assembly may be contacted with a substrate surface to be abraded, and at least one of the abrasive article backup plate assembly or substrate surface may be moved relative to the other. For example, the abrasive article backup plate assembly may be rotated about an axis.

The abrasive article backup plate assembly according to the present invention includes a support member made of materials sufficiently clear to allow observation through the support member, and as such does not require registration or alignment with viewing windows or viewing areas of an abrasive article prior to mounting the abrasive article backup plate assembly onto a grinder system. The clear backup plate can be universally used with many different shapes and configurations of abrasive articles.

BRIEF DESCRIPTION OF THE DRAWING

The accompanying drawing is included to provide a further understanding of the present invention and is incorporated in and constitutes a part of this specification. The drawing illustrates exemplary embodiments of the present invention and together with the description serves to further explain the principles of the invention. Other aspects of the present invention and many of the attendant advantages of the present invention will be readily appreciated as the same becomes better understood by reference to the following Detailed Description when considered in connection with the accompanying drawing, in which like reference numerals designate like parts throughout the figures.

DETAILED DESCRIPTION

Observation through the support member and viewing window/area (e.g., of the abraded surface) includes observation by a person having normal (including corrected) 20:20 vision, as well as electronic and electrical/mechanical observation systems, which typically are utilized in conjunction with a central processing unit, and in some cases a robot as well.

Figure 1:
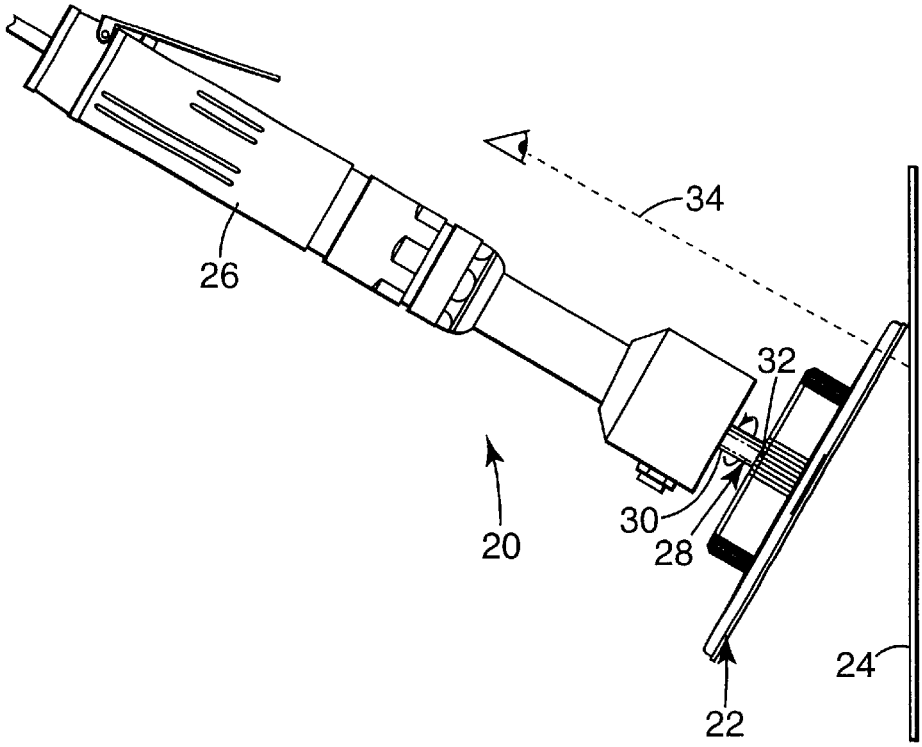
FIG. 1 is a perspective view illustrating an exemplary grinder system in accordance with the present invention.

In FIG. 1, grinder system in accordance with the present invention 20 is generally shown. Grinder system 20 provides for observation of an abraded portion of work surface 24 through abrasive article backup plate assembly according to the present invention 22 during operation of grinder system 20. Preferably, the abraded portion of the work surface is optically viewable through the abrasive article backup plate assembly.

In one aspect, grinder system 20 is an angled grinder having grinder body 26 with rotatable shaft 28 extending longitudinally therefrom. The rotatable shaft includes first end 30 and second end 32. Rotatable shaft 28 extends from grinder body 26 at first end 30. Abrasive article backup plate assembly 22 is secured to second end 32 and maintained stationary relative to rotatable shaft 28 during operation of grinder system 20. In one aspect, grinder system 20 has a typical rotational speed of between 4,000 and 12,000 revolutions per minute (rpm), although a particular grinder system may be designed for higher or lower rotational speeds. Work surface 24 is optically viewable through abrasive article backup plate assembly 22 during operation of grinder system 20, indicated by optical path 34. Optionally, grinder system 20 may be a different type of grinder system (e.g., an orbital or vibrating grinder system).

Figure 2:
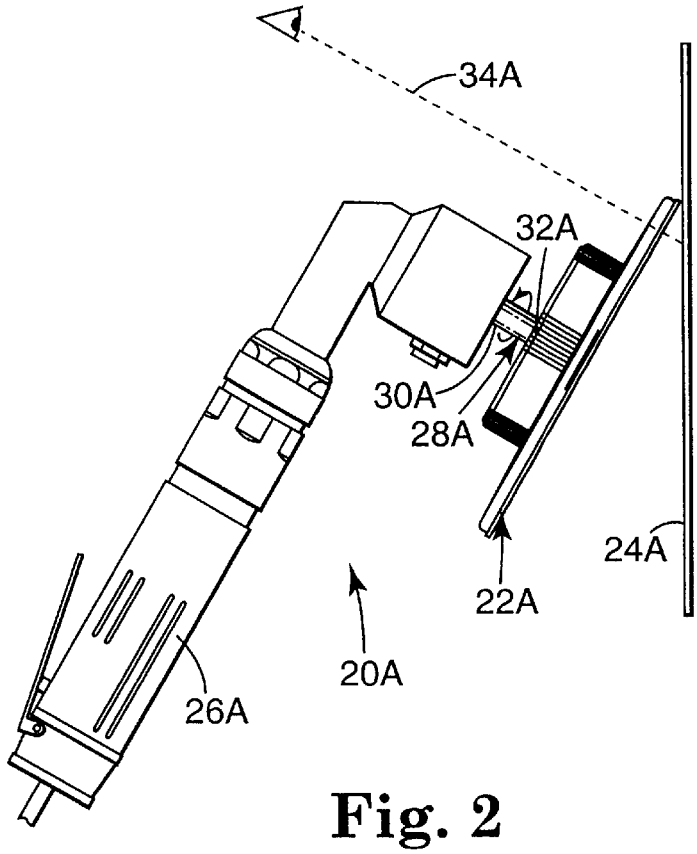
FIG. 2 is a perspective view illustrating another exemplary grinder system in accordance with the present invention.

FIG. 2 is a perspective view illustrating another exemplary embodiment of a grinder system in accordance with the present invention, generally illustrated at 20A. Grinder system 20A is a "right angle" grinder, and is similar to the grinder system 20 illustrated in FIG. 1. As such, like elements are labeled with a reference character "A" following the element number. As known to one skilled in the art, a right angle grinder includes a portion of grinder body 26A which is at a right angle to rotatable shaft 28A.

Figure 3:
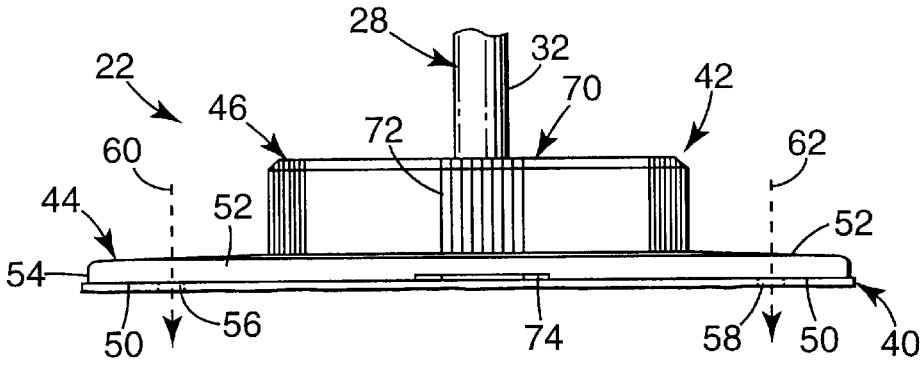
FIG. 3 is an enlarged perspective view illustrating an abrasive article backup plate assembly illustrated in the grinder system of FIG. 1 or FIG. 2.

FIG. 3 is an enlarged side view of one exemplary embodiment of abrasive article backup plate assembly 22. Abrasive article backup plate assembly 22 includes abrasive article 40 secured to backup plate 42. Abrasive article 40 can be, for example, a coated abrasive article, a bonded abrasive article, or a non-woven abrasive article. Other suitable abrasive articles will become apparent to those skilled in the art after reading this application.

Backup plate 42 includes support member 44 and hub system 46. Hub system 46 is formed integral support member 44, or is formed separate from support member 44. In one aspect, support member 44 is generally disc shaped.

Support member 44 is an outwardly extending flange defined by first major surface 50 and second major surface 52. First major surface 50 supports abrasive article 40. Abrasive article 40 includes viewing windows 56, 58. At least a portion of support member 44 is made of a material sufficiently clear to allow observation of a work surface collectively through support member 44 and abrasive article viewing windows 56, 58 during rotation of assembly 22 about an axis substantially perpendicular to first major surface 50, indicated by observation lines 60, 62.

Abrasive article 40 is fixedly secured against the first major surface 50 of support member 44. In one aspect, hub system 46 includes hub mounting assembly 70. Hub mounting assembly 70 operates to securely maintain backup plate 42 at the second end 32 of rotatable shaft 28. In one aspect, hub mounting assembly 70 includes first retainer nut 72 positioned within hub system 46. Optionally, first retainer nut 72 can be insert molded within hub system 46. In one aspect, first retainer nut 72 is made of steel. In other aspects, first retainer nut 72 is made of other metals or a rigid polymeric material (e.g., aluminum, brass, etc.). First retainer nut 72 is threaded for positioning backup plate 42 on the rotatable shaft 28. In one aspect, second retainer nut 74 is provided for securing abrasive article 40 against first major surface 52. Second retainer nut 74 may be formed as part of abrasive article 40, or may be separate from abrasive article 40. Again, second retainer nut 74 is threaded, allowing abrasive article 40 to be positioned (i.e., tightened) against backup plate 42 and on second end 32 of rotatable shaft 28.

Figure 4:
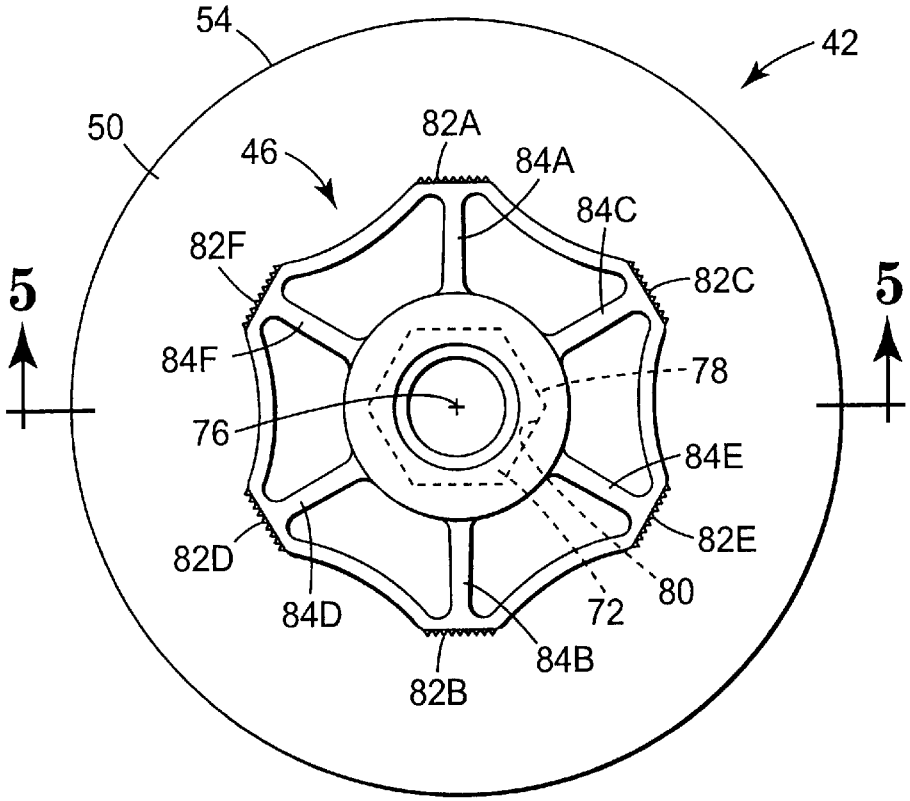
FIG. 4 is a plan view illustrating one exemplary embodiment of a backup plate in accordance with the present invention.

FIG. 4 is a plan view illustrating an exemplary embodiment of backup plate 42 according to the present invention. In one aspect, backup plate 42 is generally disc shaped. Optionally, backup plate 42 may not be disc shaped (e.g., square shaped, hexagonal shaped, etc.). Hub system 46 is centrally positioned on backup plate 42. Central axis 76 is defined as an axis which extends substantially perpendicular (i.e., orthogonal) to first major surface 50. Hub system 46 is centered on backup plate central axis 76. Hub system 46 includes central cavity 78 defined by cavity wall 80. First retainer nut 72 is positioned within central cavity 78, and more preferably insert molded within central cavity 78.

Hub system 46 includes gripping members 82. Pairs of opposing gripping members 82 are symmetrically positioned about backup plate central axis 76 (indicated as gripping members 82A, 82B; 82C, 82D; and 82E, 82F). Hub system 46 further includes plurality of support ribs 84A, 84B, 84C, 84D, 84E, 84F, extending from cavity wall 80 and extending radially from backup plate central axis 76. Support ribs 84A, 84B, 84C, 84D, 84E, 84F provide support to corresponding gripping members 82A, 82B, 82C, 82D, 82E, 82F. Gripping members 82A, 82B, 82C, 82D, 82E and 82F are useful in gripping backup plate 42 while positioning and tightening backup plate 42 on the shaft 28 and/or positioning and tightening abrasive article 40 on abrasive article backup plate assembly 22.

Figure 5:
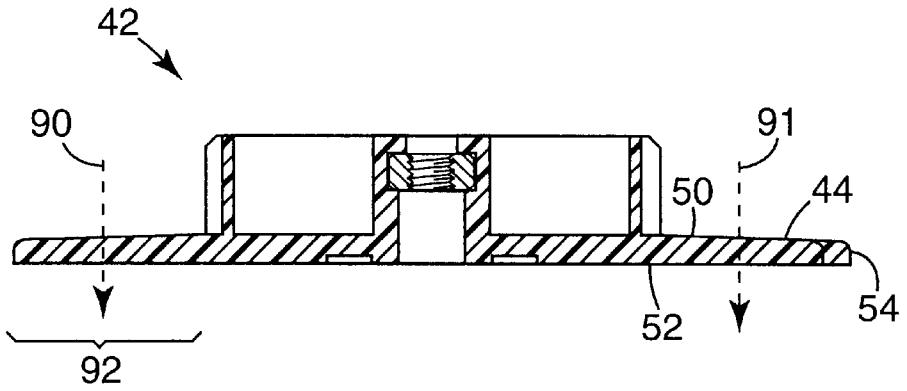
FIG. 5 is a cross-sectional view of a backup plate taken along line 5—5 of FIG. 4.

FIG. 5 is a cross-section view of backup plate 42 taken along lines 5—5 of FIG. 4. Support member 44 is made of a material sufficiently clear to allow observation of a work surface through support member 44 during grinder operation, indicated by observation lines 90, 91. Preferably, the material is sufficiently clear such that a work surface is viewable therethrough by a human with normal vision (i.e., herein referred to as "optically clear") during grinder operation. In one aspect, entire support member 44 is optically clear. Support member 44 includes outer periphery 92. In another aspect, entire outer periphery 92 is optically clear. In yet another aspect, an outer 50% of outer periphery 92 is optically clear. In one embodiment, support member 44 is made of a substantially rigid polymeric material. In one preferred embodiment, the polymeric material is a polycarbonate. Preferably, hub system 46 is integrally molded with support member 44. Hub system 46 may or may not be made of a material sufficiently clear to allow observation of the work surface through hub system 46 during rotation of the abrasive article backup plate assembly. In one aspect, hub system 46 is optically clear. Hub system 46 preferably is made of a substantially rigid polymeric material, and more preferably, the polymeric material is a polycarbonate.

Figure 6:
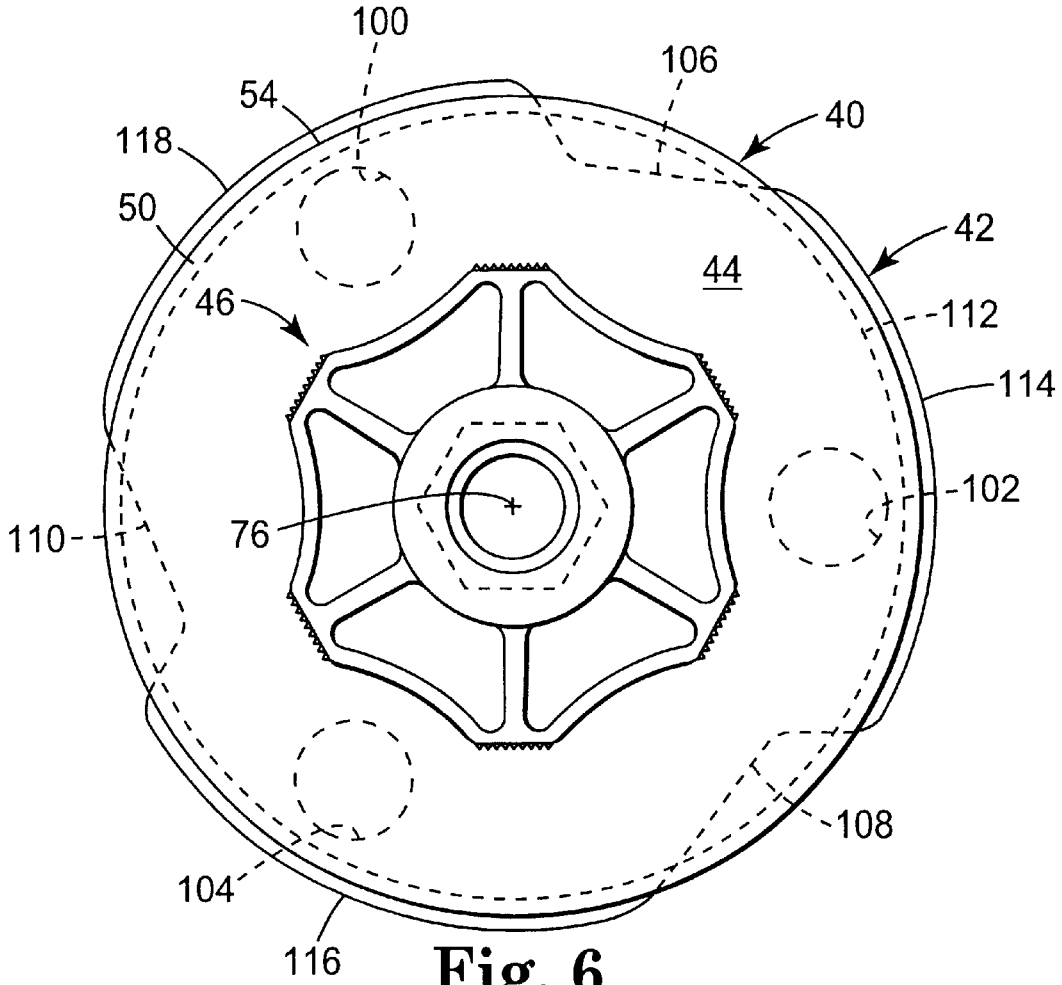
FIG. 6 is a plan view illustrating an exemplary embodiment of an abrasive article backup plate assembly according to the present invention, wherein an abraded surface of a workpiece is observable through the assembly.

FIG. 6 is a plan view illustrating abrasive article backup plate assembly 22, illustrating backup plate 42 positioned over abrasive article 40. Detailed element numbers have been left out for clarity. In the exemplary embodiment illustrated, backup plate 42, and in particular support member 44, is made of an optically clear polycarbonate. Abrasive article 40 is generally disc shaped. Abrasive article 40 includes a plurality of viewing areas or viewing windows, indicated as viewing window 100, viewing window 102 and viewing window 104. Window 100, window 102 and window 104 are symmetrically spaced about central axis 76 providing rotational symmetry to assembly 22. Abrasive article 40 includes additional viewing areas 106, 108, 110. Abrasive article 40 includes an abrasive surface (not illustrated in this view) having an average diameter 112. Portions of the abrasive surface project beyond the average diameter 112 such that there are viewing areas defined between adjacent portions of the abrasive surface that project beyond the average diameter of the abrasive surface. In reference to abrasive article 40, portions 114, 116, 118 extend or project beyond the average diameter 112 to define viewing area 106 between adjacent portions 112, 118, viewing areas 108 between adjacent portions 114, 116, and viewing area 110 between adjacent portions 116, 118 which project beyond the average diameter 112 of the abrasive surface.

In one aspect, viewing areas 106, 108, 110 are symmetrically spaced about an outer periphery of abrasive article 40. When rotated at a medium or high speed during a grinder operation, an abraded surface is optically viewable through viewing windows 100, 102, 104 and viewing areas 106, 108, 110. Since support member 44 is optically clear, backup plate 42 does not require registration or alignment with the viewing windows 100, 102, 104 and viewing areas 106, 108, 110 of abrasive article 40 prior to mounting abrasive article backup plate assembly 22 onto a grinder system. Additionally, optically clear backup plate 42 can be universally useable with many different shapes and configurations of abrasive articles.

Figure 7:
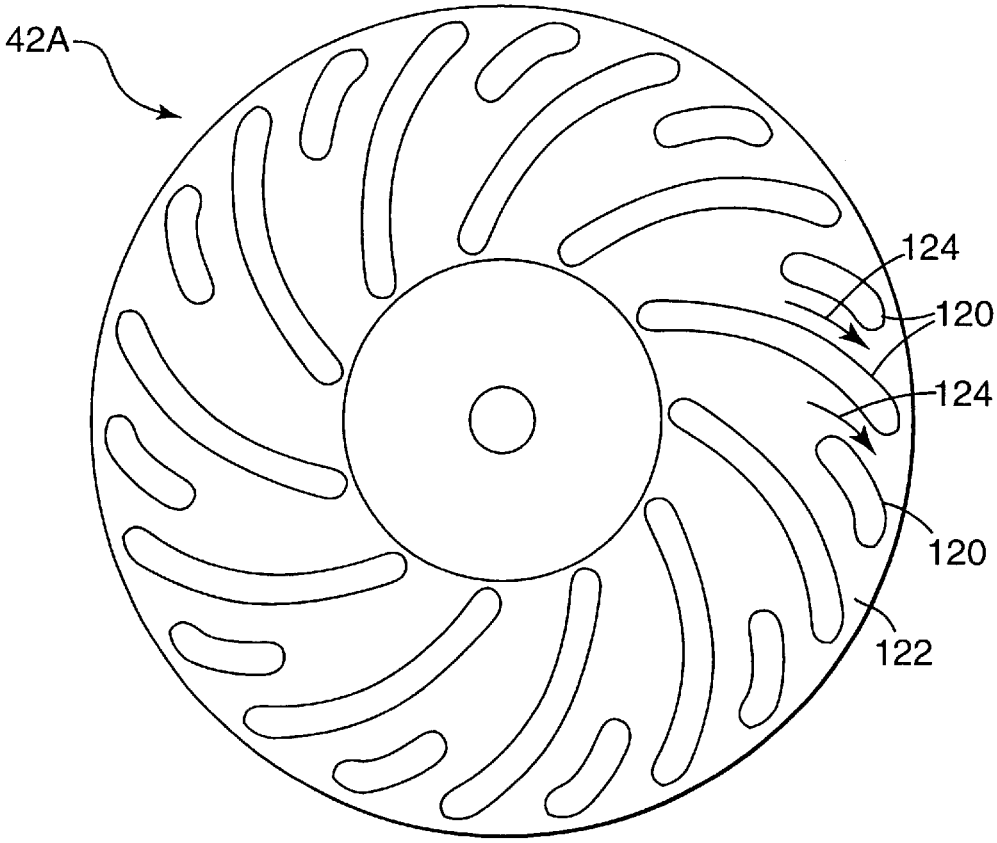
FIG. 7 is a plan view illustrating an exemplary backup plate used in an abrasive article backup plate assembly in accordance with the present invention.
Figure 8:
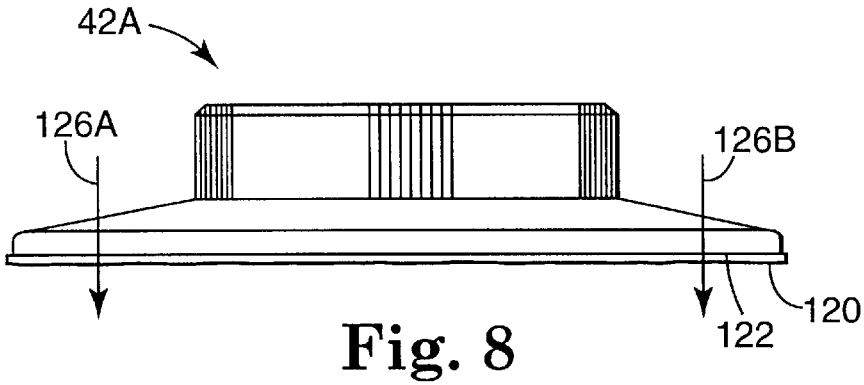
FIG. 8 is a side view of the backup plate of FIG. 7.

FIG. 7 is a plan view illustrating another exemplary embodiment of a backup plate, indicated as backup plate 42A, according to the present invention. Backup plate 42A includes cooling ribs 120 extending from major surface 122. Rotation of backup plate 42A during grinder operation provides dust, and swarf removal/cooling channels defined by cooling ribs 120. In reference also to FIG. 8, backup plate 42A is made of a material sufficiently clear to allow observation of a work surface through backup plate 42A during grinder operation, indicated by arrows 126A, 126B. Preferably, backup plate 42A is made of an optically clear polymeric material, and more preferably an optically clear polycarbonate.

FIGS. 9–12 illustrate exemplary embodiments of abrasive article designs suitable for use with abrasive article backup plate assembly 22 according to the present invention. Since the backup plate used in the present invention allows a work surface to be observable therethrough, the backup plate may be used with many different abrasive article designs. The design of the abrasive article is no longer required to match the design of the backup plate such that alignment and registration is required before mounting an abrasive article backup plate assembly on a grinder system. Other suitable abrasive article designs will become apparent to one skilled in the art after reading the present application. A detailed disclosure of exemplary suitable abrasive article materials and abrasive article types suitable for use with the abrasive article backup plate assembly according to the present invention is discussed in detail in this specification.

Figure 9:
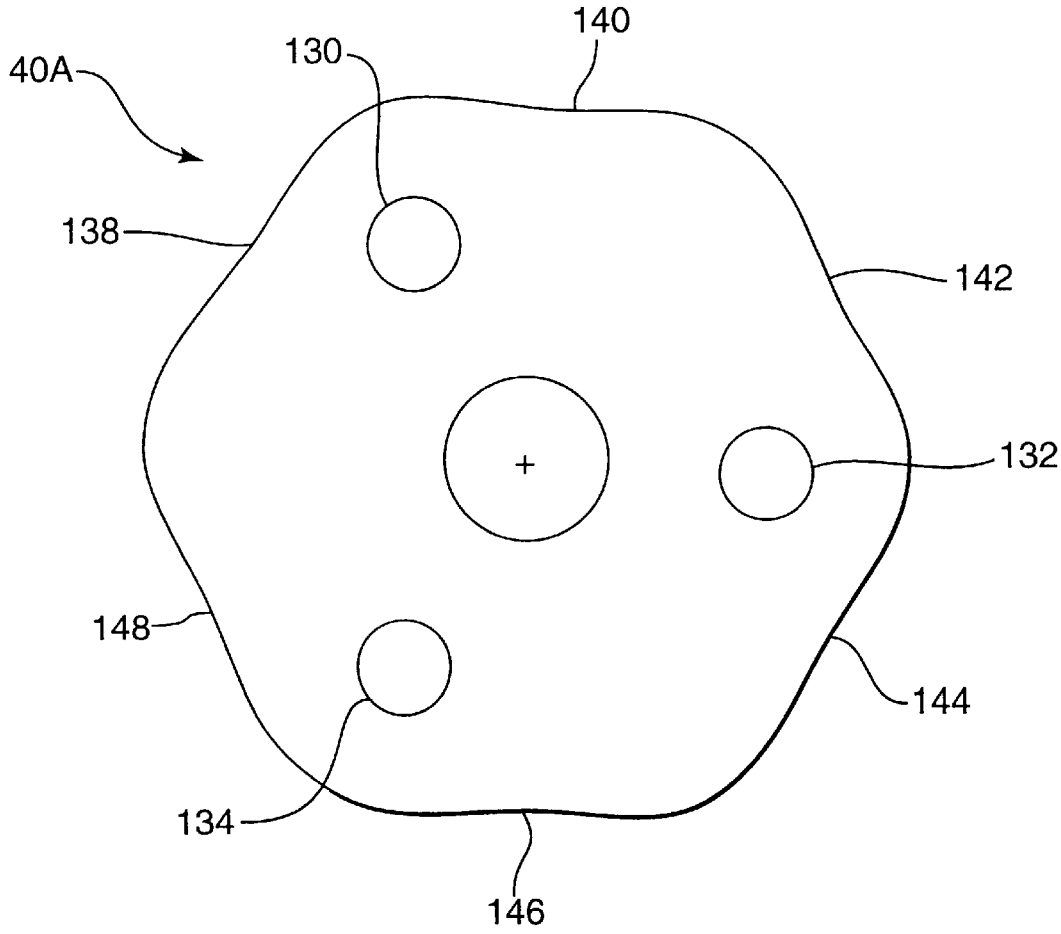
FIG. 9 is a plan view illustrating an exemplary abrasive article used in an abrasive article backup plate assembly in accordance with the present invention.

In FIG. 9 abrasive article 40A is substantially disc shaped, and includes plurality of viewing areas or viewing windows 130, 132, 134. Viewing windows 130, 132, 134 are symmetrically located about central point 136 providing symmetry during rotation of abrasive article 40A. Abrasive article 40A also includes viewing areas 138, 140, 142, 144, 146, 148 located about the outer circumference of abrasive article 40A. The combination of viewing windows 130, 132, 134 and viewing areas 138, 140, 142, 144, 146, 148 provide for increased viewing area of an abraded portion of a work surface.

Figure 10:
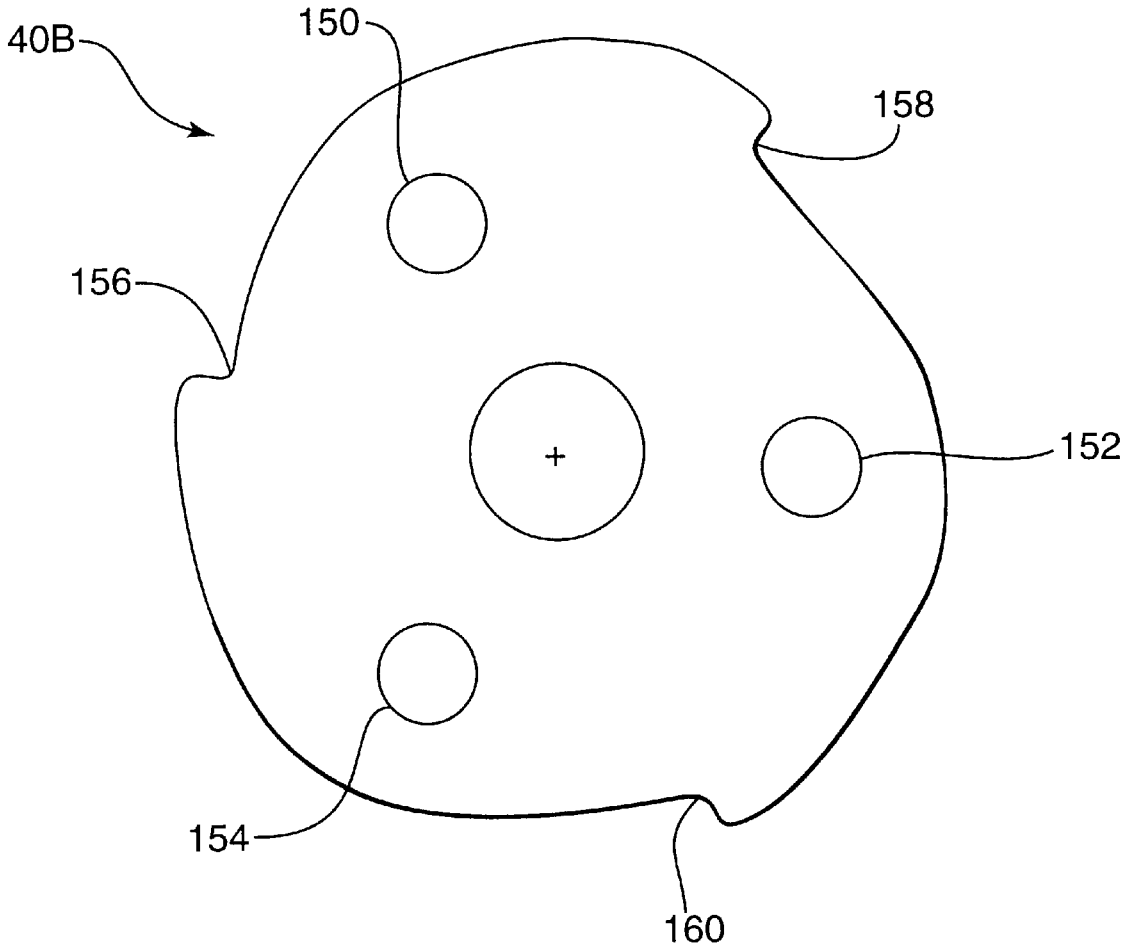
FIG. 10 is a plan view illustrating an exemplary abrasive article used in an abrasive article backup plate assembly in accordance with the present invention.

FIG. 10 illustrates another exemplary embodiment of abrasive article 40B suitable for use in an abrasive article backup plate assembly according to the present invention. Abrasive article 40B is substantially disc shaped and includes symmetrically spaced viewing areas or windows 150, 152, 154. Further, asymmetric viewing areas 156, 158, 160 are located about an outer periphery of abrasive article 40B. Viewing areas 156, 158, 160 extend substantially radially inward, providing for enhanced viewing of an abraded portion of a work surface.

Figure 11:
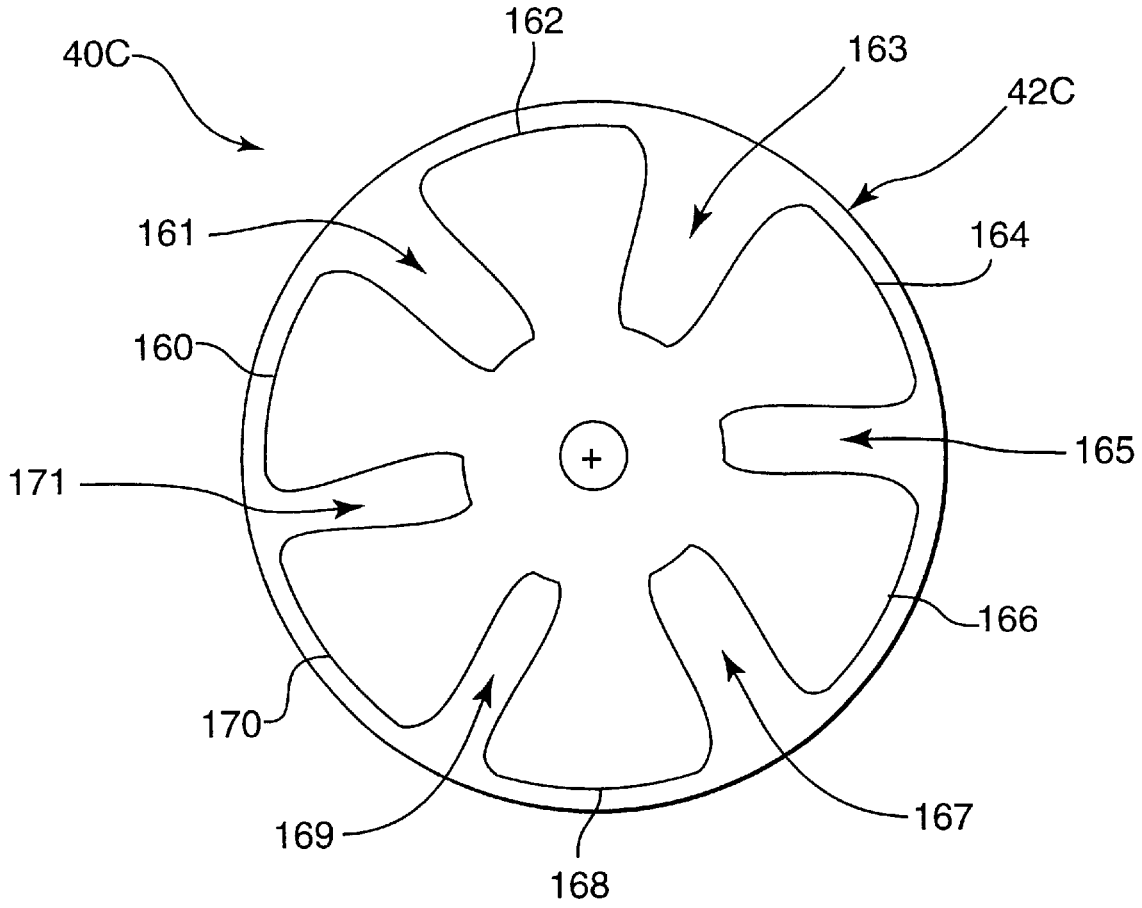
FIG. 11 is a plan view illustrating an exemplary abrasive article used in an abrasive article backup plate assembly in accordance with the present invention.

FIG. 11 illustrates another exemplary embodiment of abrasive article 40C suitable for use in an abrasive article assembly according to the present invention. Abrasive article 40C is substantially disc shaped and has a "daisy" abrasive article design configuration, and is illustrated adjacent backup plate 42C. The daisy configuration includes petals 160, 162, 164, 166, 168, 170 symmetrically located about center point 172 and extending radially therefrom. Petals 160, 162, 164, 166, 168, 170 are spaced apart, providing viewing of an abraded work surface via corresponding viewing windows or areas 161, 163, 165, 167, 169 and 171. Abrasive article 40C having a daisy design configuration is known to be useful for grinding operations involving grinding and polishing of curved surfaces.

Figure 12:
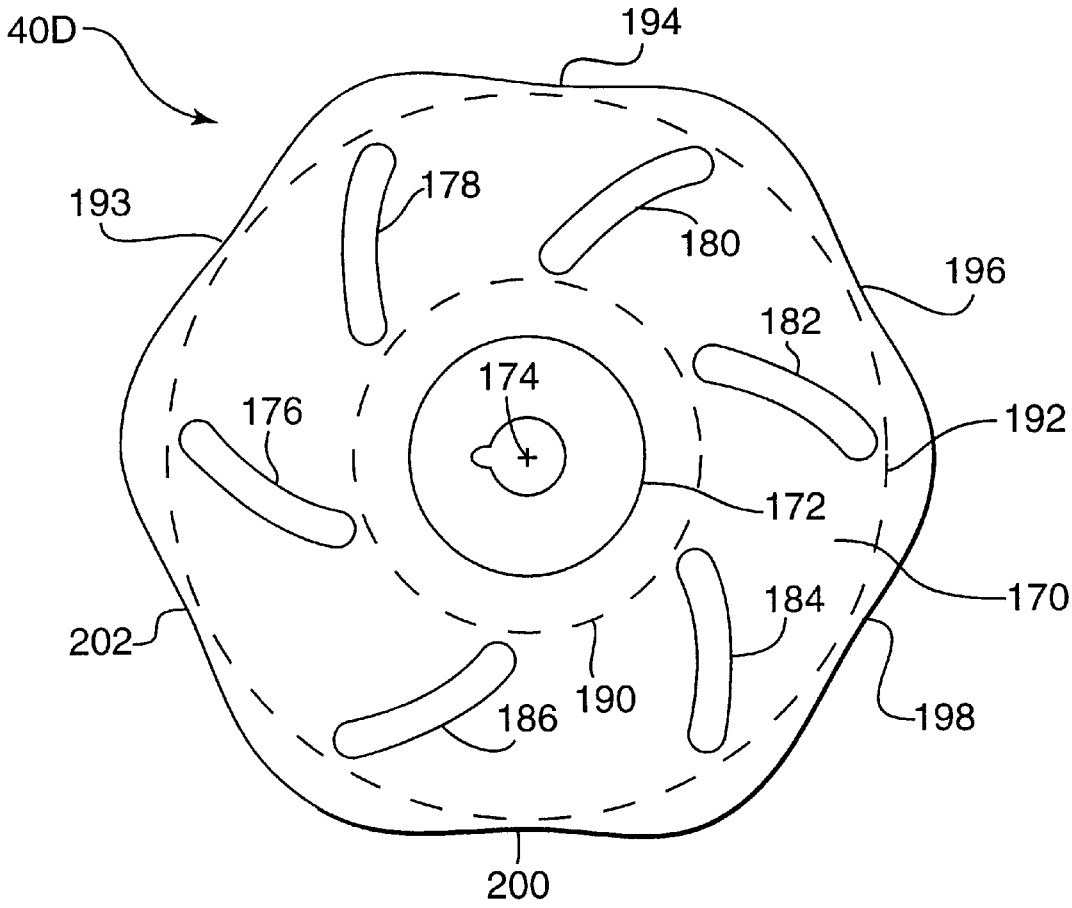
FIG. 12 is a plan view illustrating an exemplary abrasive article used in an abrasive article backup plate assembly in accordance with the present invention.

FIG. 12 illustrates another exemplary embodiment of an abrasive article, indicated as abrasive article 40D, suitable for use with an abrasive article backup plate assembly according to the present invention. Abrasive article 40D provides for good viewing of an abraded work surface while reducing the amount of material removed from the abrasive article. Abrasive article 40D is substantially disc shaped, and includes abrasive work surface 170 positioned about centrally disposed hub 172. Hub 172 is located at central axis 174. Abrasive article 40D includes longitudinally extending viewing areas or viewing windows 176, 178, 180, 182, 184, 186. Longitudinal viewing windows 176, 178, 180, 182, 184, 186 extend radially from a central portion 190 to outer circumference 192. In one aspect, the longitudinal viewing windows 176, 178, 180, 182, 184, 186 are generally arc-shaped. As such, the radially extending longitudinal viewing windows provide for maximum viewing of an abraded portion of a work surface while minimizing the circumferential material in abrasive work region 170 maintaining structural integrity of the work region. Abrasive article 40D further includes viewing areas 193, 194, 196, 198, 200, 202 positioned symmetrically about an outer circumference of abrasive article 40D. The viewing areas 193, 194, 196, 198, 200, 202 and longitudinally extending viewing windows 176, 178, 180, 182, 184, 186 provide an improved viewing region of an abraded portion of a work surface during grinder operation.

Figure 13:
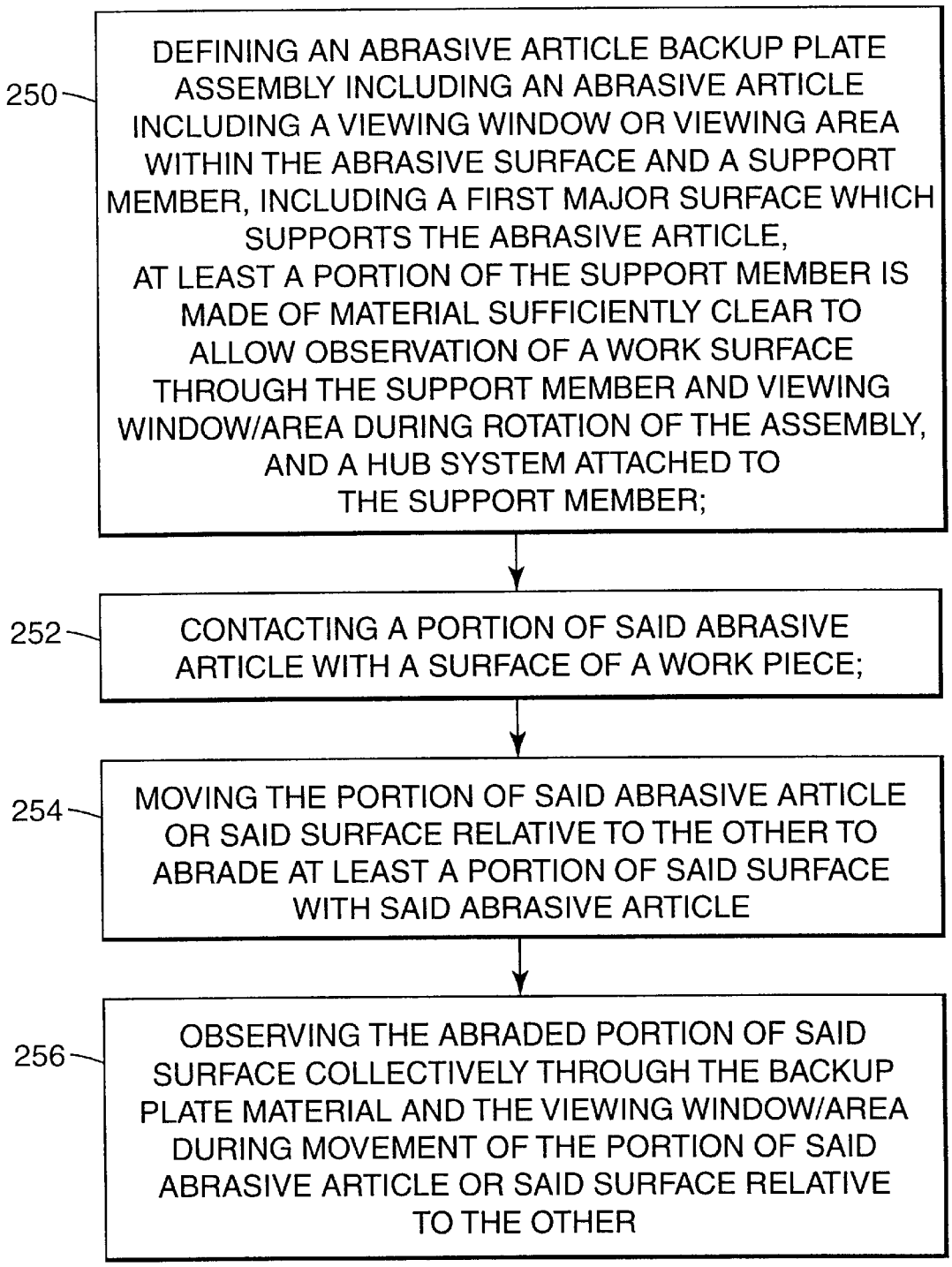
FIG. 13 is a flow diagram illustrating one exemplary embodiment of a method of abrading a surface according to the present invention.

FIG. 13 is a flow diagram illustrating one exemplary embodiment of a method of abrading a surface according to the present invention. At 250, an abrasive article backup plate assembly is defined. The abrasive article backup plate assembly includes an abrasive article having an abrasive surface that includes a viewing window and/or area within the abrasive surface, and a support member including a first major surface which supports the abrasive article. At least a portion of the support member is made of material sufficiently clear to allow observation of a work surface collectively through the support member and the viewing window/area during rotation of the assembly about an axis substantially perpendicular to the first major surface. A hub system is attached to the support member.

At 252, a portion of the abrasive article is contacted with a surface of a workpiece. At 254, the portion of the abrasive article or the surface is moved relative to the other to abrade at least a portion of the surface with the abrasive article. At 256, the abraded portion of the surface is observable collectively through the backup plate material and the viewing window/area during movement of the portion of the abrasive article or the surface relative to the other. It is understood that rotation/movement of the abrasive article and/or surface to be abraded is sufficient to allow observation of the surface.

Abrasive Articles

A viewing area(s) (including a viewing window(s)), if not already present, can be added to abrasive articles, for example, by cutting, stamping, etc. the abrasive article to have the desired viewing area(s). For example, holes can be punched into a coated abrasive article to provide a viewing window(s). Also see, for example, co-pending application having U.S. Ser. No. 09/607,210, filed Jun. 30, 2000, the disclosure of which is incorporated herein by reference. General details regarding the making of abrasive articles are described in the following paragraphs. Other suitable abrasive articles may become apparent to one skilled in the art after reading this application.

Coated Abrasives

Coated abrasive products generally include a backing, abrasive particles, and at least one binder to hold the abrasive particles onto the backing. The backing can be any suitable material, including cloth, polymeric film, fibre, non-woven webs, paper, combinations thereof, and treated versions thereof. The binder can be any suitable binder, including an inorganic or organic binder (including thermally curable resins and radiation curable resins). The abrasive particles can be present in one layer or in two layers of the coated abrasive product.

Figure 14:
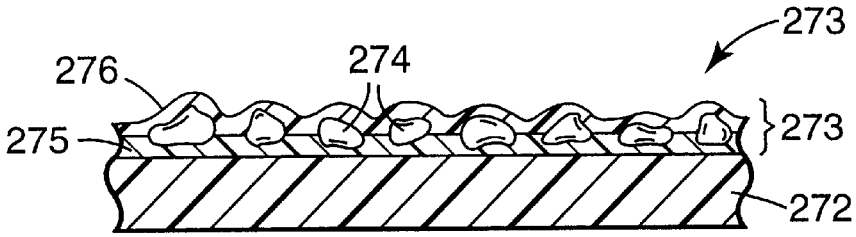
FIG. 14 is an enlarged, cross-sectional view illustrating one exemplary embodiment of a coated abrasive article used in an abrasive article backup plate assembly in accordance with the present invention.

An example of a coated abrasive product is depicted in FIG. 14. Referring to this figure, coated abrasive product 271 has a backing (substrate) 272 and abrasive layer 273. Abrasive layer 273 includes abrasive particles 274 secured to a major surface of backing 272 by make coat 275 and size coat 276. In some instances, a supersize coat (not shown) is used.

Bonded Abrasives

Bonded abrasive products typically include a shaped mass of abrasive particles held together by an organic, metallic, or vitrified binder. Such shaped mass can be, for example, in the form of a wheel, such as a grinding wheel or cutoff wheel. The diameter of grinding wheels typically is about 1 cm to over 1 meter; the diameter of cut off wheels about 1 cm to over 80 cm (more typically 3 cm to about 50 cm). The cut off wheel thickness is typically about 0.5 mm to about 5 cm, more typically about 0.5 mm to about 2 cm. The shaped mass can also be in the form, for example, of a honing stone, segment, mounted point, disc (e.g. double disc grinder) or other conventional bonded abrasive shape. Bonded abrasive products typically comprise about 3–50% by volume bond material, about 30–90% by volume abrasive particles (or abrasive particle blends), up to 50% by volume additives (including grinding aids), and up to 70% by volume pores, based on the total volume of the bonded abrasive product.

Non-Woven Abrasive Articles

Non-woven abrasive products typically include an open porous lofty polymer filament structure having fused abrasive particles according to the present invention distributed throughout the structure and adherently bonded therein by an organic binder. Examples of filaments include polyester fibers, polyamide fibers, and polyaramid fibers. A non-woven abrasive product may comprise a fibrous mat as a substrate, onto which fused abrasive particles are adhered by a binder. It is also within the scope of the present invention for porous areas between filaments to be viewing windows/areas.

Molded Abrasive Brushes

Useful abrasive brushes include those having a plurality of bristles unitary with a backing (see, e.g., U.S. Pat. Nos. 5,427,595 (Pihl et al.), 5,443,906 (Pihl et al.), 5,679,067 (Johnson et al.), and 5,903,951 (Ionta et al.), the disclosure of which is incorporated herein by reference). Preferably, such brushes are made by injection molding a mixture of polymer and abrasive particles.

Components of Abrasive Products

Suitable organic binders for making abrasive products include thermosetting organic polymers. Examples of suitable thermosetting organic polymers include phenolic resins, urea-formaldehyde resins, melamine-formaldehyde resins, urethane resins, acrylate resins, polyester resins, aminoplast resins having pendant $\alpha,\beta$-unsaturated carbonyl groups, epoxy resins, acrylated urethane, acrylated epoxies, and combinations thereof. The binder and/or abrasive product may also include additives such as fibers, lubricants, wetting agents, thixotropic materials, surfactants, pigments, dyes, antistatic agents (e.g., carbon black, vanadium oxide, graphite, etc.), coupling agents (e.g., silanes, titanates, zircoaluminates, etc.), plasticizers, suspending agents, and the like. The amounts of these optional additives are selected to provide the desired properties. The coupling agents can improve adhesion to the abrasive particles and/or filler. The binder chemistry may thermally cured, radiation cured or combinations thereof. Additional details on binder chemistry may be found in U.S. Pat. Nos. 4,588,419 (Caul et al.), 4,751,137 (Tumey et al.), and 5,436,063 (Follett et al.), the disclosures of which are incorporated herein by reference.

Binder materials may also contain filler materials or grinding aids, typically in the form of a particulate material. Typically, the particulate materials are inorganic materials. Examples of useful fillers for this invention include: metal carbonates (e.g., calcium carbonate (e.g., chalk, calcite, marl, travertine, marble, and limestone), calcium magnesium carbonate, sodium carbonate, magnesium carbonate), silica (e.g., quartz, glass beads, glass bubbles and glass fibers) silicates (e.g., talc, clays, (montmorillonite) feldspar, mica, calcium silicate, calcium metasilicate, sodium aluminosilicate, sodium silicate) metal sulfates (e.g., calcium sulfate, barium sulfate, sodium sulfate, aluminum sodium sulfate, aluminum sulfate), gypsum, vermiculite, wood flour, aluminum trihydrate, carbon black, metal oxides (e.g., calcium oxide (lime), aluminum oxide, titanium dioxide), and metal sulfites (e.g., calcium sulfite).

In general, the addition of a grinding aid increases the useful life of the abrasive product. A grinding aid is a material that has a significant effect on the chemical and physical processes of abrading, which results in improved performance. Although not wanting to be bound by theory, it is believed that a grinding aid(s) will (a) decrease the friction between the abrasive particles and the workpiece being abraded, (b) prevent the abrasive particles from "capping" (i.e., prevent metal particles from becoming welded to the tops of the abrasive particles), or at least reduce the tendency of abrasive particles to cap, (c) decrease the interface temperature between the abrasive particles and the workpiece, and/or (d) decreases the grinding forces.

Grinding aids encompass a wide variety of different materials and can be inorganic or organic based. Examples of chemical groups of grinding aids include waxes, organic halide compounds, halide salts and metals and their alloys. The organic halide compounds will typically break down during abrading and release a halogen acid or a gaseous halide compound. Examples of such materials include chlorinated waxes like tetrachloronaphtalene, pentachloronaphthalene, and polyvinyl chloride. Examples of halide salts include sodium chloride, potassium cryolite, sodium cryolite, ammonium cryolite, potassium tetrafluoroboate, sodium tetrafluoroborate, silicon fluorides, potassium chloride, and magnesium chloride. Examples of metals include, tin, lead, bismuth, cobalt, antimony, cadmium, and iron titanium. Other miscellaneous grinding aids include sulfur, organic sulfur compounds, graphite, and metallic sulfides. It is also within the scope of the present invention to use a combination of different grinding aids, and in some instances this may produce a synergistic effect. The preferred grinding aid is cryolite; the most preferred grinding aid is potassium tetrafluoroborate.

Grinding aids can be particularly useful in coated abrasive and bonded abrasive products. In coated abrasive products, grinding aid is typically used in the supersize coat, which is applied over the surface of the abrasive particles. Sometimes, however, the grinding aid is added to the size coat. Typically, the amount of grinding aid incorporated into coated abrasive products are about 50–300 g/m$^2$ (preferably, about 80–160 g/m$^2$). In vitrified bonded abrasive products grinding aid is typically impregnated into the pores of the product.

Examples of suitable conventional abrasive particles include fused aluminum oxide (including white fused alumina, heat-treated aluminum oxide and brown aluminum oxide), silicon carbide, boron carbide, titanium carbide, diamond, cubic boron nitride, garnet, fused alumina-zirconia, and sol-gel-derived abrasive particles, and the like. The sol-gel-derived abrasive particles may be seeded or non-seeded. Likewise, the sol-gel-derived abrasive particles may be randomly shaped or have a shape associated with them, such as a rod or a triangle. Examples of sol gel abrasive particles include those described U.S. Pat. Nos. 4,314,827 (Leitheiser et al.), 4,518,397 (Leitheiser et al.), 4,623,364 (Cottringer et al.), 4,744,802 (Schwabel), 4,770,671 (Monroe et al.), 4,881,951 (Wood et al.), 5,011,508 (Wald et al.), 5,090,968 (Pellow), 5,139,978 (Wood), 5,201,916 (Berg et al.), 5,227,104 (Bauer), 5,366,523 (Rowenhorst et al.), 5,429,647 (Larmie), 5,498,269 (Larmie), and 5,551,963 (Larmie), the disclosures of which are incorporated herein by reference. Additional details concerning sintered alumina abrasive particles made by using alumina powders as a raw material source can also be found, for example, in U.S. Pat. Nos. 5,259,147 (Falz), 5,593,467 (Monroe), and 5,665,127 (Moltgen), the disclosures of which are incorporated herein by reference. In some instances, blends of abrasive particles may result in an abrasive article that exhibits improved grinding performance in comparison with abrasive articles comprising 100% of either type of abrasive particle.

If there is a blend of abrasive particles, the abrasive particle types forming the blend may be of the same size. Alternatively, the abrasive particle types may be of different particle sizes. For example, the larger sized abrasive particles may be abrasive particles according to the present invention, with the smaller sized particles being another abrasive particle type. Conversely, for example, the smaller sized abrasive particles may be abrasive particles according to the present invention, with the larger sized particles being another abrasive particle type.

Examples of suitable diluent particles include marble, gypsum, flint, silica, iron oxide, aluminum silicate, glass (including glass bubbles and glass beads), alumina bubbles, alumina beads and diluent agglomerates. Fused abrasive particles according to the present invention can also be combined in or with abrasive agglomerates. Abrasive agglomerate particles typically comprise a plurality of abrasive particles, a binder, and optional additives. The binder may be organic and/or inorganic. Abrasive agglomerates may be randomly shape or have a predetermined shape associated with them. The shape may be a block, cylinder, pyramid, coin, square, or the like. Abrasive agglomerate particles typically have particle sizes ranging from about 100 to about 5000 micrometers, typically about 250 to about 2500 micrometers. Additional details regarding abrasive agglomerate particles may be found, for example, in U.S. Pat. Nos. 4,311,489 (Kressner), 4,652,275 (Bloecher et al.), 4,799,939 (Bloecher et al.), 5,549,962 (Holmes et al.), and 5,975,988 (Christianson), the disclosures of which are incorporated herein by reference.

The abrasive particles may be uniformly distributed in the abrasive article or concentrated in selected areas or portions of the abrasive article. For example, in a coated abrasive, there may be two layers of abrasive particles. The first layer comprises abrasive particles other than abrasive particles according to the present invention, and the second (outermost) layer comprises abrasive particles according to the present invention. Likewise in a bonded abrasive, there may be two distinct sections of the grinding wheel. The outermost section may comprise abrasive particles according to the present invention, whereas the innermost section does not. Alternatively, abrasive particles according to the present invention may be uniformly distributed throughout the bonded abrasive article.

Further details regarding coated abrasive products can be found, for example, in U.S. Pat. Nos. 4,734,104 (Broberg), 4,737,163 (Larkey), 5,203,884 (Buchanan et al.), 5,152,917 (Pieper et al.), 5,378,251 (Culler et al.), 5,417,726 (Stout et al.), 5,436,063 (Follett et al.), 5,496,386 (Broberg et al.), 5,609,706 (Benedict et al.), 5,520,711 (Helmin), 5,954,844 (Law et al.), 5,961,674 (Gagliardi et al.), and 5,975,988 (Christinason), the disclosures of which are incorporated herein by reference. Further details regarding bonded abrasive products can be found, for example, in U.S. Pat. Nos. 4,543,107 (Rue), 4,741,743 (Narayanan et al.), 4,800,685 (Haynes et al.), 4,898,597 (Hay et al.), 4,997,461 (Markhoff-Matheny et al.), 5,038,453 (Narayanan et al.), 5,110,332 (Narayanan et al.), and 5,863,308 (Qi et al.), the disclosures of which are incorporated herein by reference. Further, details regarding vitreous bonded abrasives can be found, for example, in U.S. Pat. Nos. 4,543,107 (Rue), 4,898,597 (Hay), 4,997,461 (Markhoff-Matheny et al.), 5,094,672 (Giles et al.), 5,118,326 (Sheldon et al.), 5,131,926 (Sheldon et al.), 5,203,886 (Sheldon et al.), 5,282,875 (Wood et al.), 5,738,696 (Wu et al.), and 5,863,308 (Qi), the disclosures of which are incorporated herein by reference. Further details regarding non-woven abrasive products can be found, for example, in U.S. Pat. No. 2,958,593 (Hoover et al.), the disclosure of which is incorporated herein by reference.

Methods for abrading with abrasive products range from snagging (i.e., high pressure high stock removal) to polishing (e.g., polishing medical implants with coated abrasive belts), wherein the latter is typically done with finer grades (e.g., less ANSI 220 and finer) of abrasive particles. The abrasive particle may also be used in precision abrading applications, such as grinding cam shafts with vitrified bonded wheels. The size of the abrasive particles used for a particular abrading application will be apparent to those skilled in the art.

Methods of Using Abrasive Products

Abrading with abrasive products may be done dry or wet. For wet abrading, the liquid may be introduced supplied in the form of a light mist to complete flood. Examples of commonly used liquids include: water, water-soluble oil, organic lubricant, and emulsions. The liquid may serve to reduce the heat associated with abrading and/or act as a lubricant. The liquid may contain minor amounts of additives such as bactericide, antifoaming agents, and the like.

Abrasive products may be used to abrade workpieces such as aluminum metal, carbon steels, mild steels, tool steels, stainless steel, hardened steel, titanium, glass, ceramics, wood, wood-like materials, paint, painted surfaces, organic coated surfaces and the like. The applied force during abrading typically ranges from about 1 to about 100 kilograms.

Numerous characteristics and advantages of the invention have been set forth in the foregoing description. It will be understood that this disclosure is, and in many respects, only illustrative. Changes can be made in details, particularly in matters of shape, size and arrangement of parts without exceeding the scope of the invention. The invention scope is defined in the language in which the appended claims are expressed.

What is claimed is:

1. A hand-held grinder abrasive article backup plate assembly comprising:

an abrasive article having an abrasive surface that includes a viewing window within the abrasive surface; and a support member including a first major surface which supports the abrasive article, wherein at least a portion of the support member is made of material sufficiently clear to collectively see through the support member and the viewing window.

2. A hand-held grinder abrasive article backup plate assembly comprising:

an abrasive article having an abrasive surface that includes a viewing window within the abrasive surface; and a support member including a first major surface which supports the abrasive article, wherein at least a portion of the support member is made of material sufficiently clear to allow observation of a work surface collectively through the support member and the viewing window during rotation of the assembly about an axis substantially perpendicular to the first major surface.

3. The assembly according to claim 2, wherein the material is sufficiently clear such that the work surface is optically viewable collectively through the support member and the viewing window during rotation of the assembly by a person with normal vision.

4. The assembly according to claim 3, wherein the abrasive surface of the abrasive article includes a plurality of viewing windows within the abrasive surface, and wherein at least a portion of the support member is made of material sufficiently clear to allow observation of a work surface collectively through the support member and at least one of the abrasive article viewing windows during rotation of the assembly about an axis substantially perpendicular to the first major surface.

5. The assembly according to claim 3, wherein the abrasive surface of the abrasive article includes a plurality of viewing windows within the abrasive surface, and wherein at least a portion of the support member is made of material sufficiently clear to allow observation of a work surface collectively through the support member and the abrasive article viewing windows during rotation of the assembly about an axis substantially perpendicular to the first major surface.

6. The assembly according to claim 3, wherein the entire support member is optically clear.

7. The assembly according to claim 3, wherein the support member has a diameter and an outer periphery, wherein the outer periphery has a diameter up to fifty percent of the diameter of the support member, and wherein the outer periphery is optically clear.

8. The assembly according to claim 3, wherein the support member includes an outer periphery, and wherein the support member is sized such that portions of the outer periphery are within 10 millimeters of an outer periphery of the grinding disc.

9. The assembly according to claim 3, wherein the support member is made of a substantially rigid polymeric material.

10. The assembly according to claim 9, wherein the polymeric material is a polycarbonate.

11. The assembly according to claim 3, further comprising a hub system attached to the support member.

12. The assembly according to claim 11, wherein the hub system is integrally molded with the support member.

13. The assembly according to claim 11, wherein the hub system includes a locking nut, wherein the locking nut is insert molded with the hub system.

14. The assembly according to claim 11, wherein the hub system includes a hub which is made of a material sufficiently clear to allow observation of the work surface through the hub during rotation of the assembly.

15. The assembly according to claim 11, wherein the hub system includes a hub member extending from the first major surface, the hub member including a pair of opposing gripping surfaces to facilitate positioning of an abrading article on the second major surface.

16. The assembly according to claim 11, wherein the hub is positioned along a central axis of the support member, wherein the central axis is orthogonal to the first major surface, and wherein the hub further includes a plurality of support ribs extending radially from the central axis.

17. The assembly according to claim 3, wherein the support member includes a plurality of ribs extending from the first major surface to facilitate cooling of the abrasive article during a grinding operation.

18. The assembly according to claim 17, wherein the ribs are symmetrically positioned about the first major surface and extend from a central location to an outer periphery of the support member.

19. The assembly according to claim 3, wherein the abrasive article is a non-woven abrasive article.

20. The assembly according to claim 3, wherein the abrasive article is a coated abrasive article.

21. The assembly according to claim 3, wherein the abrasive article is a grinding disc.

22. The assembly according to claim 21, wherein the grinding disc includes a hub for attaching the grinding disc to a grinder.

23. The assembly according to claim 3, wherein the abrasive article is an abrasive brush article.

24. An abrasive article backup plate assembly comprising:

an abrasive article having an abrasive surface having an average diameter, wherein a portion of the abrasive surface projects beyond the average diameter such that there is a first viewing area between a first two adjacent portions of the abrasive surface that project beyond the average diameter of the abrasive surface; and a support member including a first major surface which supports the abrasive article, wherein a portion of the support member is made of material sufficiently clear to collectively see through the support member and the abrasive article viewing area.

25. An abrasive article backup plate assembly comprising:

an abrasive article having an abrasive surface having an average diameter, wherein a portion of the abrasive surface projects beyond the average diameter such that there is a first viewing area between a first two adjacent portions of the abrasive surface that project beyond the average diameter of the abrasive surface; and a support member including a first major surface which supports the abrasive article, wherein a portion of the support member is made of material sufficiently clear to allow observation of a work surface collectively through the support member and the abrasive article viewing area during rotation of the assembly about an axis substantially perpendicular to the first major surface.

26. The assembly according to claim 25, wherein the material is sufficiently clear such That the work surface is optically viewable collectively through the support member and the viewing area during rotation of the assembly by a person with normal vision.

27. The assembly according to claim 26, wherein a portion of the abrasive surface projects beyond the average diameter such that there is a second viewing area between a second two adjacent portions of the abrasive surface that project beyond the average diameter of the abrasive surface.

28. The assembly according to claim 27, wherein said abrasive article is a daisy abrasive article having petals, and wherein the petals are formed at least in part from the portion of the abrasive surface that projects beyond the average diameter of the abrasive surface.

29. The assembly according to claim 26, wherein the abrasive surface of the abrasive article includes at least one viewing window within the abrasive surface, and wherein at least a portion of the support member is made of material sufficiently clear to allow observation of a work surface collectively through the support member and the abrasive article viewing window during rotation of the assembly about an axis substantially perpendicular to the first major surface.

30. The assembly according to claim 26, wherein the abrasive surface of the abrasive article includes a plurality of viewing windows within the abrasive surface, and wherein at least a portion of the support member is made of material sufficiently clear to allow observation of a work surface collectively through the support member and the abrasive article viewing windows during rotation of the assembly about an axis substantially perpendicular to the first major surface.

31. The assembly according to claim 26, wherein the first viewing area is a viewing window.

32. A hand-held grinder system comprising:

a grinder having a longitudinally extending shaft;

an abrasive article having an abrasive surface that includes a viewing window within the abrasive surface;

a support member including a first major surface which supports the abrasive article, wherein at least a portion of the support member is made of material sufficiently clear to allow observation of a work surface collectively through the support member and the viewing window during rotation of the assembly about an axis substantially perpendicular to the first major surface; and a hub system attached to the support member wherein the hub system is connectable to the longitudinally extending shaft.

33. The grinder system according to claim 32, wherein the material is sufficiently clear such that the work surface is optically viewable collectively through the support member and the viewing window during rotation of the assembly by a person with normal vision.

34. The grinder system according to claim 33, wherein the abrasive surface of the abrasive article includes a plurality of viewing windows within the abrasive surface, and wherein at least a portion of the support member is made of material sufficiently clear to allow observation of a work surface collectively through the support member and at least one of the abrasive article viewing windows during rotation of the assembly about an axis substantially perpendicular to the first major surface.

35. The grinder system according to claim 33, wherein the abrasive surface of the abrasive article includes a plurality of viewing windows within the abrasive surface, and wherein at least a portion of the support member is made of material sufficiently clear to allow observation of a work surface collectively through the support member and the abrasive article viewing windows during rotation of the assembly about an axis substantially perpendicular to the first major surface.

36. The grinder system according to claim 33, wherein the grinder is a right angle grinder.

37. A grinder system comprising:

a grinder having a longitudinally extending shaft;

an abrasive article having an abrasive surface having an average diameter, wherein a portion of the abrasive surface projects beyond the average diameter such that there is a first viewing area between a first two adjacent portions of the abrasive surface that project beyond the average diameter of the abrasive surface;

a support member including a first major surface which supports the abrasive article, wherein at least a portion of the support member is made of material sufficiently clear to allow observation of a work surface collectively through the support member and the viewing area during rotation of the assembly about an axis substantially perpendicular to the first major surface; and a hub system attached to the support member wherein the hub system is connectable to the longitudinally extending shaft.

38. A grinder system according to claim 37, wherein the material is sufficiently clear such that the work surface is optically viewable collectively through the support member and the viewing window during rotation of the assembly by a person with normal vision.

39. The grinder system according to claim 37, wherein the grinder is a right angle grinder.

40. A method of abrading a surface comprising:

providing a hand-held grinder abrasive article backup plate assembly including an abrasive article having an abrasive surface that includes a viewing window within the abrasive surface, and a support member including a first major surface which supports the abrasive article, wherein at least a portion of the support member is made of materials sufficiently clear to allow observation of a work surface collectively through the support member and a viewing window during rotation of the assembly about an axis substantially perpendicular to the first major surface, and a hub system attached to the support member;

contacting a portion of the abrasive article with a surface of a work piece;

moving the portion of the abrasive article or said surface relative to the other to abrade at least a portion of said surface with said abrasive article; and observing the abraded portion of the surface collectively through the backup plate material and the abrasive material viewing window during movement of the portion of the abrasive article or said surface relative to the other.

41. A method of abrading a surface comprising:

providing an abrasive article backup plate assembly including (i) an abrasive article having an abrasive surface having an average diameter, wherein a portion of the abrasive surface projects beyond the average diameter such that there is a first viewing area between a first two adjacent portions of the abrasive surface that project beyond the average diameter of the abrasive surface, and (ii) a support member including a first major surface which supports the abrasive article, wherein at least a portion of the support member is made of materials sufficiently clear to allow observation of a work surface collectively through the support member and a viewing area during rotation of the assembly about an axis substantially perpendicular to the first major surface, and a hub system attached to the support member;

contacting a portion of the abrasive article with a surface of a work piece;

moving the portion of the abrasive article or said surface relative to the other to abrade at least a portion of said surface with said abrasive article; and observing the abraded portion of the surface collectively through the backup plate material and the abrasive material viewing area during movement of the portion of the abrasive article or said surface relative to the other.

* * * * *

UNITED STATES PATENT AND TRADEMARK OFFICE

CERTIFICATE OF CORRECTION

PATENT NO. : 6,722,955 B2
DATED : April 20, 2004
INVENTOR(S) : Telischak, John Jr.

It is certified that error appears in the above-identified patent and that said Letters Patent is hereby corrected as shown below:

Title page,
Item [56], References Cited, U.S. PATENT DOCUMENTS, please add the following references:

-- 6,045,439 04/04/2000 Birang et al.
6,074,287 06/13/2000 Miyaji et al. --
FOREIGN PATENT DOCUMENTS, please add the following reference:

-- EP 0 882 551 A2 12/09/1998 --

Column 13,
Line 46, delete “claim 11” and insert in place thereof -- claim 1 --

Column 14,
Line 40, delete “That” and insert in place thereof -- that --

Signed and Sealed this

Ninth Day of November, 2004

JON W. DUDAS
*Director of the United States Patent and Trademark Office*

UNITED STATES PATENT AND TRADEMARK OFFICE

CERTIFICATE OF CORRECTION

PATENT NO. : 6,722,955 B2
DATED : April 20, 2004
INVENTOR(S) : Telischak, John Jr.

It is certified that error appears in the above-identified patent and that said Letters Patent is hereby corrected as shown below:

Title page,
Item [54], Title, delete "BUCKUP PLATE ASSEMBLY FOR GRINDING SYSTEM" and insert in place -- BACKUP PLATE ASSEMBLY FOR GRINDING SYSTEM --.

Signed and Sealed this

Eleventh Day of April, 2006

JON W. DUDAS
*Director of the United States Patent and Trademark Office*